US007861483B2

(12) United States Patent
Dammers

(10) Patent No.: US 7,861,483 B2
(45) Date of Patent: Jan. 4, 2011

(54) FLOOR PANEL WITH THE TONGUE MORE ELASTIC THAN THE LOCKING ELEMENT

(76) Inventor: Dirk Dammers, Friesenweg 70, Neukirchen-Vluyn (DE)

( * ) Notice: Subject to any disclaimer, the term of this patent is extended or adjusted under 35 U.S.C. 154(b) by 803 days.

(21) Appl. No.: 11/663,322

(22) PCT Filed: Sep. 9, 2005

(86) PCT No.: PCT/EP2005/009684

§ 371 (c)(1),
(2), (4) Date: Mar. 19, 2007

(87) PCT Pub. No.: WO2006/032378

PCT Pub. Date: Mar. 30, 2006

(65) Prior Publication Data

US 2007/0266666 A1 Nov. 22, 2007

(30) Foreign Application Priority Data

Sep. 17, 2004 (DE) ..... 20 2004 014 680 U
Sep. 29, 2004 (DE) ..... 20 2004 015 275 U

(51) Int. Cl.
*E04F 13/16* (2006.01)

(52) U.S. Cl. ..... 52/588.1; 52/592.1; 52/592.4

(58) Field of Classification Search ..... 52/588.1, 52/592.1, 592.4
See application file for complete search history.

(56) References Cited

U.S. PATENT DOCUMENTS

| | | | | |
|---|---|---|---|---|
| 6,158,183 | A * | 12/2000 | Snell | 52/268 |
| 6,421,970 | B1 * | 7/2002 | Martensson et al. | 52/592.1 |
| 6,772,568 | B2 * | 8/2004 | Thiers et al. | 52/592.1 |
| 2004/0031227 | A1 | 2/2004 | Knauseder | 52/592.1 |
| 2004/0128934 | A1 | 7/2004 | Hecht | 52/578 |
| 2007/0022695 | A1 * | 2/2007 | Magnusson | 52/592.1 |

* cited by examiner

*Primary Examiner*—Richard E Chilcot, Jr.
*Assistant Examiner*—Matthew J Smith
(74) *Attorney, Agent, or Firm*—Berenato & White, LLC

(57) ABSTRACT

The invention relates to a panel, with a tongue on a longitudinal and a transverse edge, projecting beyond said longitudinal or transverse edge, with essentially parallel tongue surfaces and a groove on the opposing longitudinal or transverse edge, enclosed by lateral panel sections, corresponding to the tongue of an adjacent panel with essentially parallel groove edges. In order to lock two adjacent panels such as to run into each other, a projecting locking element is provided on at least one tongue surface at least in parts and in each region of (a) panel section(s) corresponding to said locking element(s) for connected panels a recess(es) is provided, whereby the region (B) of the tongue with the locking element and/or at least one of the regions of the tongue and the panel sections which are in contact on introducing the tongue into the groove, before the locking element clips into the recess, have an elastic embodiment such that said elasticity is greater than the elasticity of the locking element.

13 Claims, 4 Drawing Sheets

Figure 1:
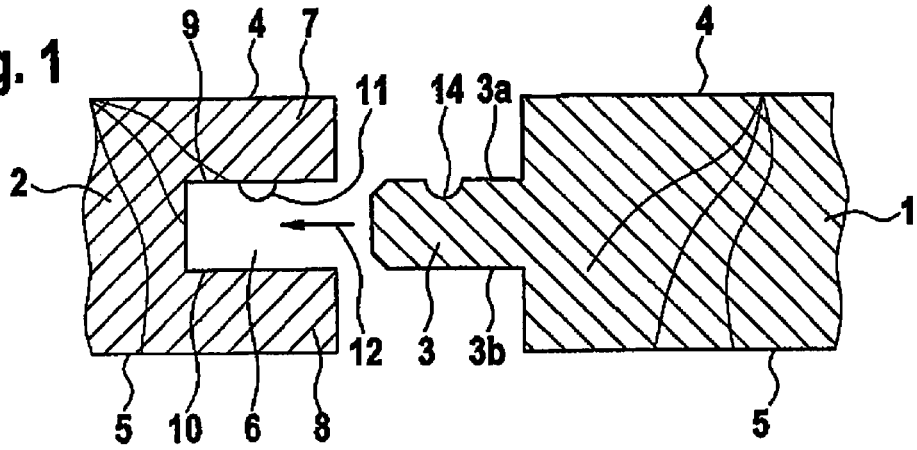

Fig. 4
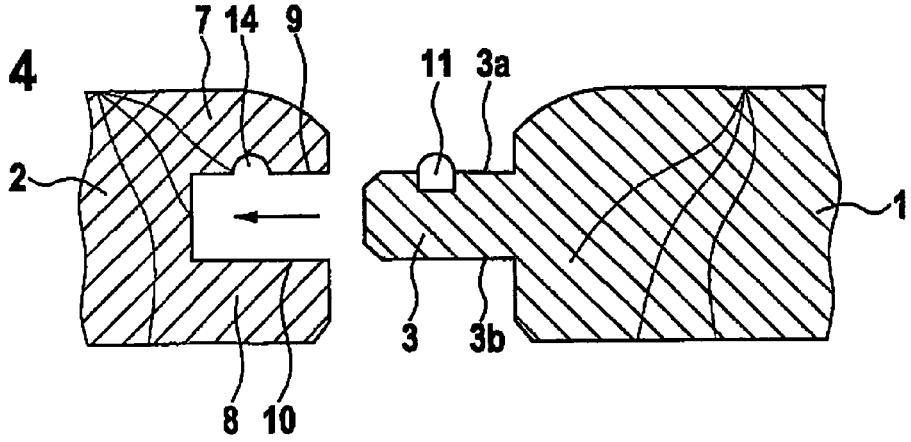
Fig. 5
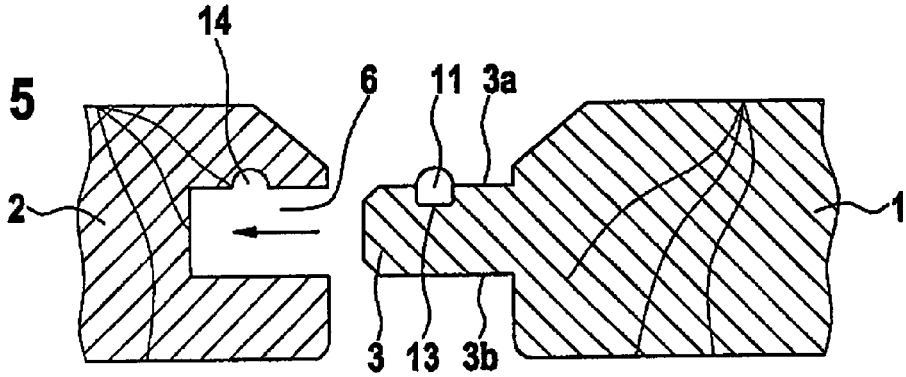
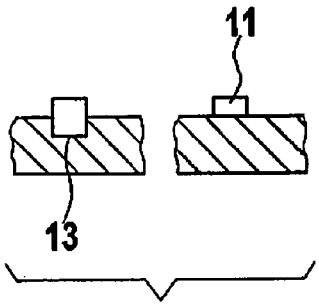
Fig. 6
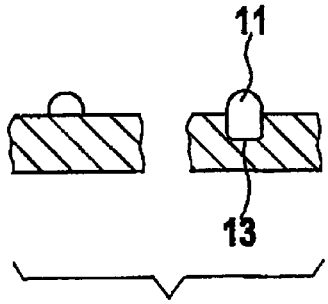
Fig. 7
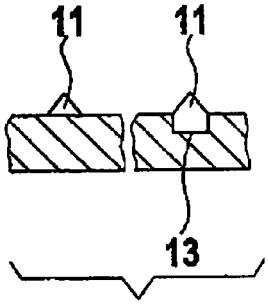
Fig. 8
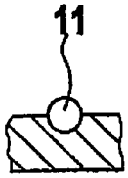
Fig. 9
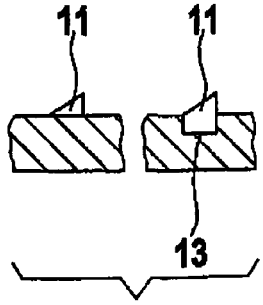
Fig. 10

FLOOR PANEL WITH THE TONGUE MORE ELASTIC THAN THE LOCKING ELEMENT

CROSS REFERENCE TO RELATED APPLICATIONS

This application is the US national phase of PCT application PCT/EP2005009684, filed 9 Sep. 2005, published 30 Mar. 2006 as WO 2006/032378, and claiming the priority of German patent application 202004014680.0 itself filed 17 Sep. 2004 and German patent application 202004015275.4 itself filed 29 Sep. 2004.

The invention relates to a panel, in particular a floor panel, which, on a longitudinal and/or transverse edge, has a tongue respectively projecting beyond the relevant longitudinal and/or transverse edge and having substantially parallel tongue surfaces and, on the opposite longitudinal and/or transverse edge, has a groove corresponding to the tongue of an adjacent panel, surrounded by lateral panel sections and having substantially parallel groove flanks; in order to lock two adjacent panels plugged into each other, at least one projecting locking element being provided on at least one tongue surface, in some regions, and a depression or depressions assigned to the locking element(s) being provided in each case in the region of the panel section(s) corresponding to the respective locking element in the panels connected to each other.

Panels of this type normally consist of wood or wood materials, such as chipboards, HDF boards (high density fiberboards) or MDF boards (medium density fiberboards). They are suitable for laying laminate or parquet floors or as wall and ceiling panels. Wood materials are normally provided with a decorative layer on the upper side. This can be a varnished or printed decorative paper which is laminated onto a carrier material. In the case of floors, on account of stress compensation, a counterbalance is also normally applied to the underside. The panel itself can be constructed with one layer or else with many layers.

In order to lock them, the panels to be connected are pushed into one another. It proves to be a disadvantage here that the panels sections are spread apart, on account of the projecting locking element (locking elements) until each locking element meets its corresponding depression during further insertion.

It is an object of the invention to improve a known panel in such a way that the above-described disadvantages are avoided.

This object is achieved in that the region of the tongue bearing the locking element and/or at least one of the regions of the tongue and the panel sections which are in contact as the tongue is inserted into the groove, before the locking element latches into the depression, in each case is (are) formed elastically in such a way that the respective elasticity is greater than the elasticity of the locking element. The locking element, on the one hand, and the region of the tongue bearing the locking element or of the tongue bearing the locking element, on the other hand, can, for example, be formed as one part or in one piece.

However, it is also entirely possible for the locking element, on one hand, and the region of the tongue bearing the locking element or the tongue bearing the locking element, on the other hand, to be formed in two parts.

The object is also achieved by a panel, in particular a floor panel, which, on a longitudinal and/or transverse edge, has a tongue respectively projecting beyond the relevant longitudinal and/or transverse edge and having substantially parallel tongue surfaces and, on the. Opposite longitudinal and/or transverse edge, a groove corresponding to the tongue of an adjacent panel, surrounded by lateral panel sections and having substantially parallel groove flanks; in order to lock two adjacent panels plugged into each other, at least one projecting locking element being provided at least one panel section, in some regions, and a depression assigned to the respective locking element being provided in each case in the region of the tongue surface corresponding to the respective locking element in the panels connected to each other, the region of the corresponding panel section bearing the locking element and/or at least one of the regions of the tongue and the panel sections which are in contact as the tongue is inserted into the groove, before the locking element latches into the depression, in each case being formed elastically in such a way that the respective elasticity is greater than the elasticity of the locking element.

As a result of the locking, the two panels connected to each other are locked in and counter to the insertion direction and also in the direction at right angles to the upper side of the panels.

The locking element can be formed, for example, as a point-like elevation. Alternatively, the locking element can be formed as an elongate elevation preferably extending in the longitudinal direction of the edge. This can be interrupted or else formed continuously.

The number of regions can vary. If only one region with a high elasticity is provided, this can preferably be compressed to such an extent that it corresponds approximately to the height of the locking element. If two corresponding regions are provided, it is sufficient, for example, if each region can be compressed approximately by half the height of the locking element.

In the arrangement of the region (regions), there are different configurations. For instance, only one region can be provided, which is part of the tongue or of the panel section. However, it is also entirely possible for two regions to be provided, distributed on the two tongue surfaces or the two panel sections or on the tongue and one panel section.

Three or four regions distributed on the tongue and the two panel sections are also conceivable. For instance, in each case one region can be provided in the region of the two tongue surfaces and in one panel section or vice versa. In addition, the arrangement of a region in each case in both tongue surfaces and in both panel sections is possible.

It is also possible for the respective complete panel section or the complete tongue to have an elasticity which is greater than the elasticity of the locking element. However, it is also entirely possible for an appropriately higher elasticity to be provided only in the region bearing the locking element or in the region that is in contact as the tongue is inserted.

The material of this region with the high elasticity and the material of the remaining part of the tongue or of the panel section that is connected thereto can in principle be different, the region being connected to the remaining part of the tongue and/or of the panel section by means of a form fit or an adhesive or another suitable fixing means.

However, the region with the higher elasticity and the remaining part of the tongue or panel section can also be fabricated from a quasi uniform material, the material being conditioned differently, for example in the region with the higher elasticity, so that the region with the higher elasticity is given a different density, for example.

The high elasticity of the panel section (panel sections) and/or of the tongue makes it possible, as the tongue of a panel is inserted into the groove of an adjacent panel, for the material of the panel section or of the tongue to be compressed by the projecting locking element(s) as a result of pivoting and/or horizontal displacement, and there is thus sufficient clearance in order that the tongue can be inserted completely into the groove without spreading the panel sections apart. Once the tongue reaches its locking position, each locking element is located approximately at the height of the corresponding depression, so that, on account of the elasticity of the panel section (panel sections) and/or the tongue, each locking element is displaced into its associated recess. During disassembly, that is to say when the tongue is pulled out of the groove, the converse sequence is followed.

The arrangement of the locking elements can be any desired. For instance, only one locking element can be arranged on the tongue or on a panel section. Alternatively, for example, in each case a locking element can be provided on the two tongue surfaces or on the two groove flanks or else optionally on one tongue surface and one groove flank.

Likewise, it is conceivable for the panel sections to be arranged flush with one another. However, it is entirely possible that, for example, the lower panel section is formed in a projecting manner.

When the panel according to the invention is used for cladding a ceiling, mounting is simplified considerably, since a panel that is still to be fixed can be inserted simply into the groove of a panel already mounted on the ceiling. On account of the latching connection, the panel which has not yet finally been mounted is fixed adequately in a slightly tilted state in this way, so that the panel can then be secured to the ceiling in a second operation, for example with nails or clamps.

The locking element, on the one hand, and the panel section bearing the locking element or the region of the panel section bearing the locking element, on the other hand, can be formed as one part or in one piece.

Alternatively, the locking element, on the one hand, and the panel section bearing the locking element or the region of the, panel section bearing the locking element, on the other hand, can be formed in two parts. The locking element itself can be, for example, inelastic, for example an elevation fabricated from metal. However, it is also entirely possible for the locking element to be at least a little elastic.

At least one locking element can be provided on the underside and/or upper side on the tongue.

In addition or alternatively, at least one locking element can be provided on the underside on the upper and/or on the upper side on the lower panel section.

At least two locking elements can be provided. These two locking elements can, for example, be arranged at the same height on opposite sides of the panel or else offset as seen in the insertion direction, on one or on two opposite sides. It is also possible, for example, for two locking elements to be arranged on the tongue and for two further locking elements to be arranged on a panel section. In addition, an arrangement of a locking element on the tongue and a locking element on the panel section is of course possible.

This is recommended if the distance between the centers of at least two locking elements deviates somewhat from the distance between the centers of the corresponding depressions. In this way, the adjacent panels are locked together more strongly since, on account of the deviation of the two distances, the locking elements exert a stress on the walls of the relevant recesses.

At least one locking element can be formed as an approximately semicircular protrusion. It is also possible for a locking element to be formed so as to rise, at least on the front side, in particular triangularly or in the shape of an arrow, for easier insertion. However, other cross-sectional shapes are also conceivable.

In order for example to avoid unintended separation of the locking element from its carrier material during disassembly, at least one locking element can be let into a countersink. By means of suitable additional measures, such as adhesive bonding, the adhesion between the locking element and the carrier material can be improved.

At least one locking element can consist of ethylene vinyl acetate or polyurethane. This can be, for example, hot melt adhesive which is applied directly to the carrier material, that is to say to the panel section or the tongue, in the heated state and here makes a connection as it cools.

The lower panel section can be formed so as to end flush with the upper panel section at the edge or be set back with respect to the latter.

The volume of the projecting locking element is preferably considerably lower than the respective volume of the region(s) of the lower or upper panel section or of the tongue that is compressed during insertion on account of the elasticity.

The surface of the panel can be rounded or beveled on at least two side edges. As a result, the individual panels abut each other at the respective side edges in the conventional way but a panel having an uneven or at least two dimensionally deformed surface is created, such as in the case of a plain jointed floor or the like. In this case, the decorative layer on the upper side can be formed as one part, that is to say also comprise the beveled or rounded regions. However, it is also entirely possible for the beveled or rounded regions to be covered with a separate decorative layer or else varnished.

In the following text, illustrated embodiments of the invention that are illustrated in the drawings will be explained.

Figure 11:
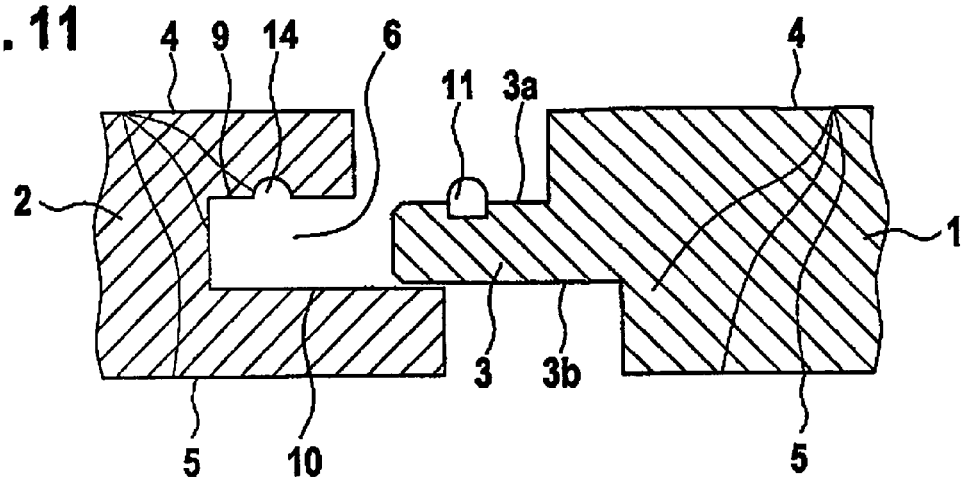
Figure 12:
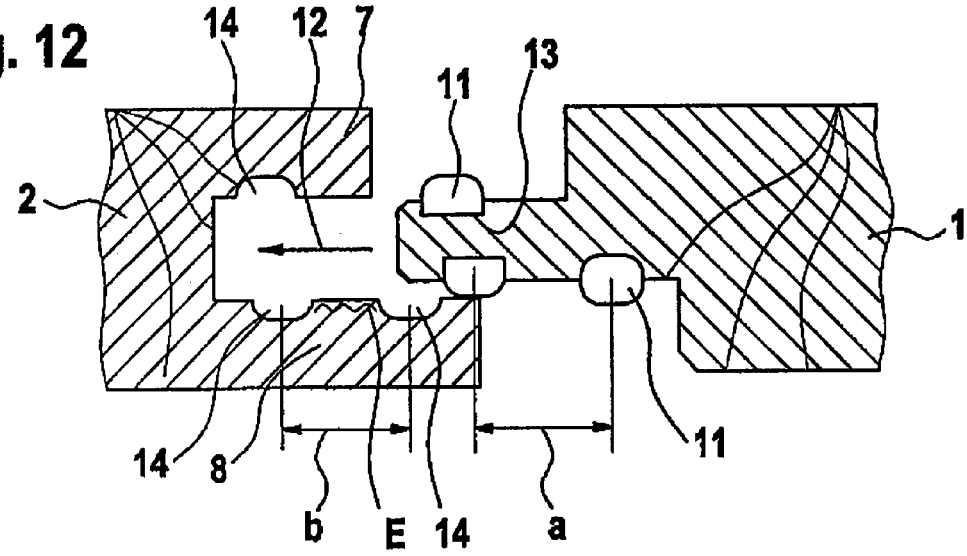
Figure 13:
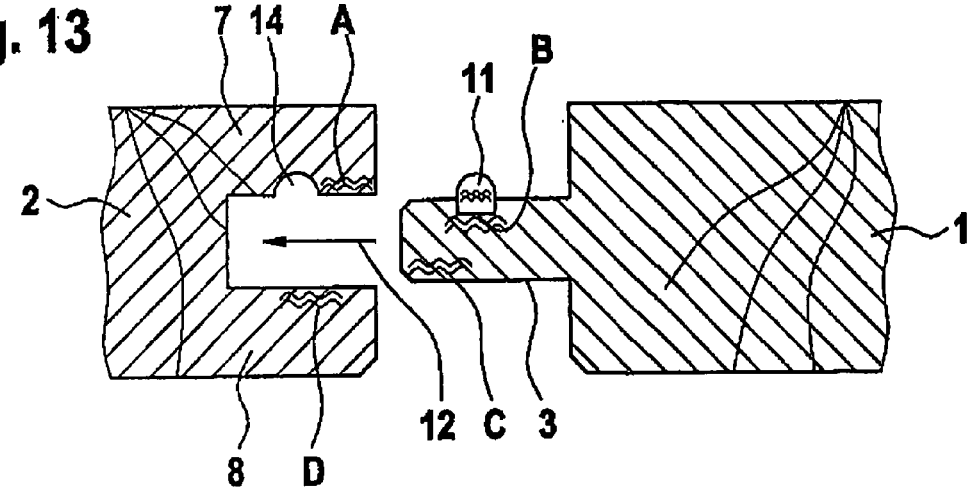
Figure 14:
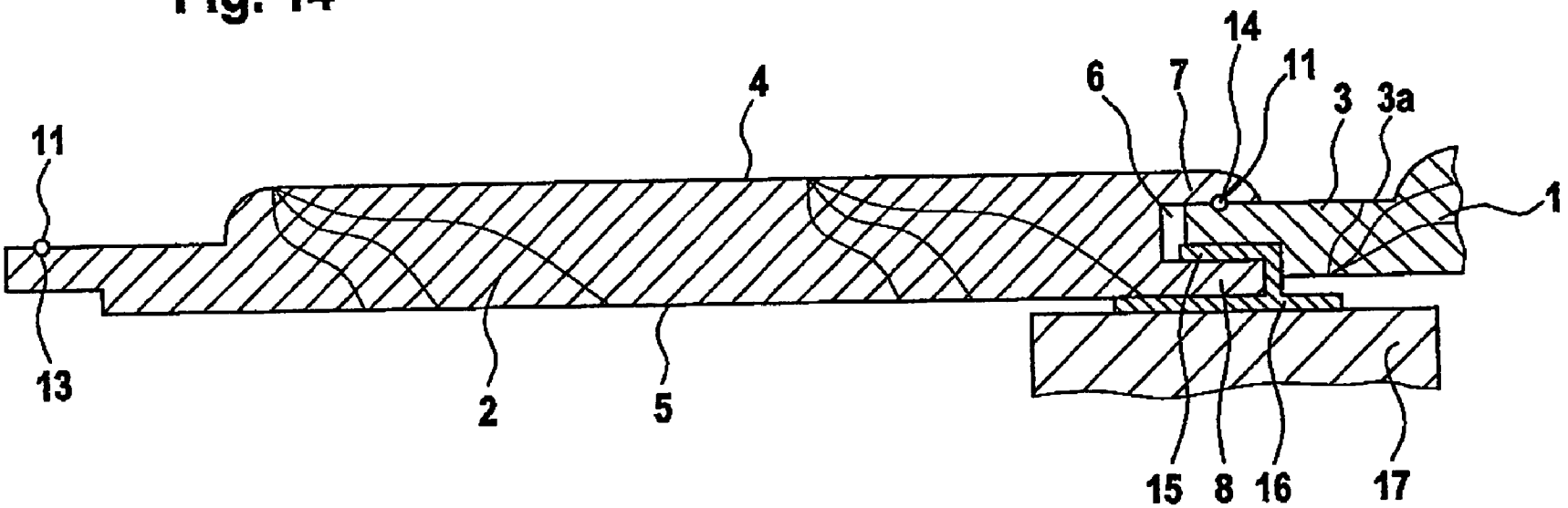

In the drawings:

FIGS. 1 to 5 show partial sections through two panels according to the invention that are to be connected to each other, FIGS. 6 to 10 show different embodiments of a locking element, FIGS. 11 to 13 show further illustrated embodiments, and FIG. 14 shows a partial section through two wall or ceiling panels connected to each other.

In all the figures, the same designations are used for the same or identical components.

In FIGS. 1 to 5 and 11 to 13, partial sections through two panels 1, 2 of different configuration that are to be connected to each other are illustrated. For the purpose of connection, on the panel 1 a tongue 3 projecting at the edge and having two substantially parallel tongue surfaces 3*a*, 3*b* is provided, which is arranged to be set back with respect to the front side 4 and with respect to the rear side 5.

The panel 2 has a groove 6 that is formed to correspond to the tongue 3 and is surrounded by an upper and lower panel section 7, 8. The groove 6 has two substantially parallel groove flanks 9, 10.

In FIGS. 1 to 5 and 13, the upper and the lower panel section 7, 8 end flush with each other. In FIGS. 11 and 12, the lower panel section 8 is formed so as to project with respect to the upper panel section 7.

In the illustrated embodiments illustrated in FIGS. 1 to 3 and 11 to 13, the side edges of the upper panel section 7 facing the respective adjacent panel 1 or 2 are aligned at right angles to the front side 4, so that to this extent the panels 1, 2 touch each other in the region of the front sides 4. FIG. 5 shows an illustrated embodiment in which the region is beveled, while in FIG. 4 a rounded illustrated embodiment of a panel 1 or 2 according to the invention is illustrated.

Figure 2:
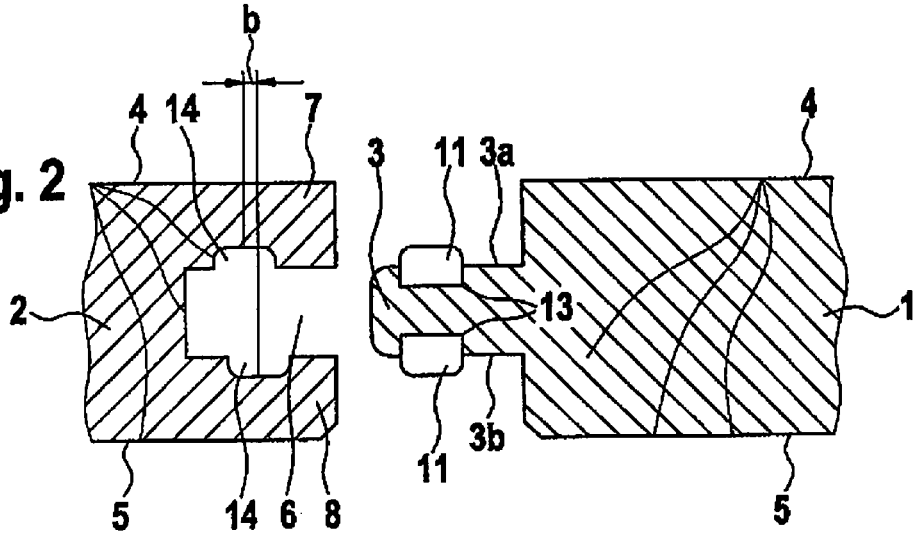
Figure 3:
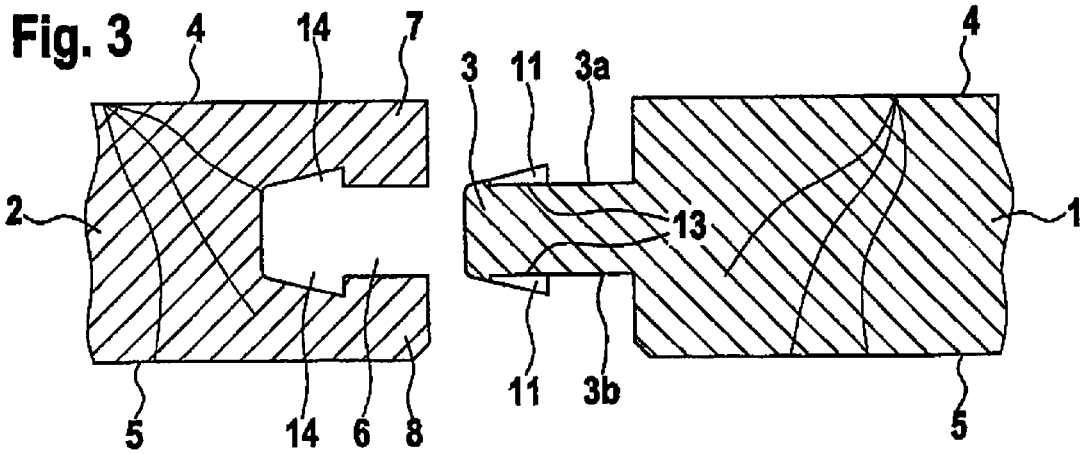

In the illustrated embodiments illustrated in FIGS. 2 to 5 and 11 to 13, on at least one tongue surface 3*a* or 3*b*, on both tongue surfaces 3*a*, 3*b* in FIGS. 2 and 3, in each case a locking element 11 is provided, which preferably extends over the complete length of the corresponding edges, which can be both the longitudinal and transverse edge. FIG. 1 shows an illustrated embodiment in which the locking element 11 is arranged on the underside of the upper panel section 7.

The locking element 11 can have different cross-sectional shapes. In FIG. 3, the locking element is formed so as to rise as seen in the insertion direction (arrow 12) and has an approximately arrow-shaped configuration. The locking element 11 is in this case let into a countersink 13 on the tongue side.

In the illustrated embodiment illustrated in FIG. 2, the locking element 11 is approximately rectangular and arranged in a countersink 13.

In FIGS. 1, 4 and 5, the locking element 11 has an approximately semicircular contour, the locking element 11 according to FIG. 1 being fixed only on the flat surface of the upper panel section 7, while in the exemplary environments according to FIGS. 4 and 5, there is a countersink 13 in each case in the tongue surface 3*a* of the tongue 3.

Further conceivable embodiments of the locking element 11 are illustrated in FIGS. 6 to 10, here both application to the upper side of the panel section 7, 8 or to the tongue 3 and also letting into a countersink 13 being possible.

The locking element 11 illustrated in FIG. 6 has an approximately rectangular cross section, the locking element 11 illustrated in FIG. 7 has an approximately semicircular cross section and the locking element 11 illustrated in FIGS. 8 and 10 has an approximately triangular cross section, the locking element 11 illustrated in FIG. 10 being formed approximately in the shape of the arrow for better insertion.

FIG. 9 illustrates a locking element 11 which has a round cross section, so that the countersink 13 for its part has a corresponding semicircular contour.

In FIG. 12, an illustrated embodiment is illustrated in which the lower panel section 8 is formed so as to protrude.

For the purpose of locking two adjacent panels 1, 2, each locking element 11 is assigned a depression 14, which is arranged in the region of the other panel 1, 2 corresponding to the locking element 11.

Thus, for example in FIG. 1 the depression 14 is provided in the tongue surface 3*a* of the tongue 3. In a configuration according to FIGS. 2 and 3, in each case a depression 14 is arranged on the panel section 7 or 8.

In the illustrated embodiment according to FIG. 12, two depressions 14 are clearly visible in the lower panel section 8 and one depression 14 in the upper panel section 7. The tongue 3 of the adjacent panel 1 accordingly has one locking element 11 on the tongue surface 3*a* and two locking elements 11 on the tongue surface 3*b*.

Whereas in this illustrated embodiment the depressions 14 is provided in the lower panel section 8, in the illustrated embodiment illustrated in FIG. 1 the depression 14 is in the tongue surface 3*a* of the tongue 3.

In order to increase the locking action, the distance a between the centers of the two locking elements 11 deviates at least somewhat from the distance b of the associated depressions 14. Therefore, the locking elements 11 exert a stress in the opposite direction on parts of the wall of the depressions 14.

A similar arrangement is also illustrated in FIG. 2. Here, the centers of the two locking elements 11 are located at the same height, while the centers of the corresponding depressions 14 are arranged at the distance b from each other.

In FIG. 13, possible arrangements of regions A, B, C and D which are compressed during assembly (in the direction of the arrow 12) or during disassembly (counter to the direction of the arrow 12) because of their greater elasticity are indicated by wavy lines.

It is entirely conceivable for only the region B bearing the locking element 11 to have an elasticity greater than the elasticity of the locking element 11. In this case, the height of this region B is chosen such that the panel 1 can be inserted into the panel 2 by means of pivoting and/or horizontal displacement in the direction of the arrow 12, without any spreading of the panel sections 7 and 8 occurring.

Other arrangements are also conceivable. For instance, the panel can have two regions A, D which have an appropriate elasticity. If two regions A, D are provided, the amount by which the regions A, D have to be compressed in total is distributed to the two regions A, D.

Of course, other combinations are also possible. For instance, only the region C could have an appropriately higher elasticity on its own or else in combination with another region A, B or D or other regions.

The regions A to D and the remaining parts of the tongue 3 and of the panel sections 7 and 8 that are adjacent thereto can consist of fundamentally different materials, which are connected by suitable means, such as adhesive or a form fit. However, it is also entirely possible for the regions A to D and the remaining parts of the tongue 3 and of the panel sections 7 and 8 that are adjacent thereto to consist of a quasi uniform material, the region(s) A to D then being conditioned differently.

If, for example, only the region A has a greater elasticity then, when inserted in the direction of the arrow 12, this region A is compressed by the height of the locking element 11 until the locking element 11 enters the corresponding depression 14 and latches in here. On account of the elasticity, the region A then assumes its original configuration again.

Since, in the illustrated embodiment illustrated in FIG. 12, two depressions 14 are provided in the lower panel element 8, the region E, which is arranged between the depressions 14, can also have a higher elasticity here, if this is necessary for an insertion for example by means of horizontal displacement.

In addition, during insertion the locking element 11 can, also be compressed if it has sufficiently elastic properties, which is likewise illustrated by wavy lines in FIG. 13.

In the embodiment illustrated in FIG. 14, the width of the groove 6 is greater than the thickness of the tongue 3 in the region inserted into the groove 6. The reason for this is that a wing 15 of a single-wing clamp 16 is also inserted into the groove 6 and, for its part, is fixed to a base 17 that is indicated, for example by means of nailing or screwing.

Provided in the tongue surface 3*a* of the tongue 3 is a semicircular countersink 13, into which the locking element 11, which has a round cross section, is introduced. Here, for example, this can be a hot melt adhesive that is applied. The corresponding depression 14 is provided on the underside of the upper panel section 7 of the panel 2.

Of course, it is possible, for example in the illustrated embodiment illustrated in FIG. 13, for two locking elements 11 arranged one after another as seen in the insertion direction (arrow 12) to be provided in the tongue surface 3*a* and for a corresponding number of depressions 14 to be provided in the upper panel section 7. Such an embodiment permits the width of the visible joint between the panels 1, 2 to be changed from a close joint as far as a joint of which the width corresponds approximately to the spacing of the locking elements 11.

The invention claimed is:

1. A panel, in particular a floor panel, which, on a longitudinal and/or transverse edge, has a tongue respectively projecting beyond the relevant longitudinal and/or transverse edge and having substantially parallel tongue surfaces and, on the opposite longitudinal and/or transverse edge, a groove corresponding to the tongue of an adjacent panel, surrounded by lateral panel sections and having substantially parallel groove flanks; in order to lock two adjacent panels plugged into each other, at least one projecting locking element being provided on at least one tongue surface, in some regions, and a depression or depressions assigned to the locking element being provided in each case in the region of the panel section corresponding to the respective locking element in the panels connected to each other, characterized in that the region of the tongue bearing the locking element and/or at least one of the regions of the tongue and the panel sections which are in contact as the tongue is inserted into the groove, before the locking element latches into the depression, in each case has a defined area of greater elastically than the respective elasticity of the locking element.

2. The panel as claimed in claim 1, characterized in that the locking element and the region of the tongue bearing the locking element are formed in two parts.

3. The panel as claimed in claim 1, characterized in that at least one locking element is provided on the underside and/or upper side on the tongue.

4. The panel as claimed in claim 1, characterized in that at least two locking elements are provided.

5. The panel as claimed in claim 1, characterized in that the distance between the centers of at least two locking elements deviates somewhat from the distance between the centers of the corresponding depressions.

6. The panel as claimed in claim 1, characterized in that at least one locking element is formed as an approximately semicircular protrusion.

7. The panel as claimed in claim 1, characterized in that at least one locking element is formed so as to rise, at least on the front side, in particular triangularly or in the shape of an arrow, for easier insertion.

8. The panel as claimed in claim 1, characterized in that at least one locking element is let into a countersink.

9. The panel as claimed in claim 1, characterized in that at least one locking element consists of ethylene vinyl acetate.

10. The panel as claimed in claim 1, characterized in that at least one locking element consists of polyurethane.

11. The panel as claimed in claim 1, characterized in that the lower panel section is formed so as to end flush with the upper panel section at the edge or to be set back with respect to the latter.

12. The panel as claimed one of claim 1, characterized in that the volume of the projecting locking element is considerably lower than the respective volume of the region of the lower or upper panel section or of the tongue that is compressed during insertion on account of the elasticity.

13. The panel as claimed in claim 1, characterized in that the surface of the panel is rounded or beveled on at least two side edges.

* * * * *